US006575183B2

(12) United States Patent
Tung

(10) Patent No.: US 6,575,183 B2
(45) Date of Patent: Jun. 10, 2003

(54) TILTABLE AND ROTATABLE CANOPY FRAME FOR A SUNSHADE

(76) Inventor: Benson Tung, No. 587, Chien-Gong Road, San-Min, Kaohsiung (TW)

( * ) Notice: Subject to any disclaimer, the term of this patent is extended or adjusted under 35 U.S.C. 154(b) by 40 days.

(21) Appl. No.: 09/924,705

(22) Filed: Aug. 9, 2001

(65) Prior Publication Data

US 2003/0029482 A1 Feb. 13, 2003

(51) Int. Cl.[7] ..... A25B 17/00
(52) U.S. Cl. ..... 135/20.3; 135/98
(58) Field of Search ..... 135/20.3, 74, 98

(56) References Cited

U.S. PATENT DOCUMENTS 558,296 A * 4/1896 McDonald
2,559,421 A * 7/1951 Garrett
2,819,725 A * 1/1958 Deisenroth et al.
2,905,187 A * 9/1959 Croce
3,486,514 A * 12/1969 Prescott
3,850,186 A * 11/1974 Weber et al.
4,068,673 A * 1/1978 Bernardi
5,678,585 A * 10/1997 May
5,836,327 A * 11/1998 Davis
5,878,762 A * 3/1999 Huang
6,220,261 B1 * 4/2001 Glatz
6,311,705 B1 * 11/2001 Ma
2001/0040208 A1 * 11/2001 Li

FOREIGN PATENT DOCUMENTS

WO WO98/07411 * 3/1998

* cited by examiner

*Primary Examiner*—Robert Canfield
(74) *Attorney, Agent, or Firm*—Rosenberg, Klein & Lee

(57) ABSTRACT

A sunshade comprises a main post, a joint rotatably mounted to an upper end of the main post, and a canopy frame pivotally mounted to the joint. The canopy frame can be pivoted relative to the joint to a desired tilt angle. In addition, a rotating device is used to turn the joint for proceeding with 360° rotational adjustment of the canopy frame relative to the ground for optimal shield.

15 Claims, 6 Drawing Sheets

TILTABLE AND ROTATABLE CANOPY FRAME FOR A SUNSHADE

BACKGROUND OF THE INVENTION

1. Field of the Invention

The present invention relates to a tiltable and rotatable canopy frame for a sunshade.

2. Description of the Related Art

A typical sunshade comprises a main post and a canopy frame pivotally mounted to an upper end of the main post. A canopy mounted to the canopy frame can be adjusted to a tilt angle relative to the main post for optimal shield. However, it is impossible to proceed with 360° rotational adjustment of the canopy relative to the ground. Consequently, in order to obtain the best shield, the user has to manually turn the bulky and heavy base of the sunshade when the incident angle of sunlight changes.

SUMMARY OF THE INVENTION

An object of the present invention is to provide a tiltable and rotatable canopy frame for a sunshade to thereby allow 360° rotational adjustment of the canopy relative to the ground Thus, difficult movement of the base of the sunshade for obtaining the best shield can be avoided.

A sunshade in accordance with the present invention comprises a main post, a joint rotatably mounted to an upper end of the main post, and a canopy frame pivotally mounted to the joint. The canopy frame can be pivoted relative to the joint to a desired tilt angle. In addition, a rotating device is used to turn the joint for proceeding with 360° rotational adjustment of the canopy frame relative to the ground for optimal shield.

Other objects, advantages, and novel features of the invention will become more apparent from the following detailed description when taken in conjunction with the accompanying drawings.

DETAILED DESCRIPTION OF THE PREFERRED EMBODIMENT

Figure 6:
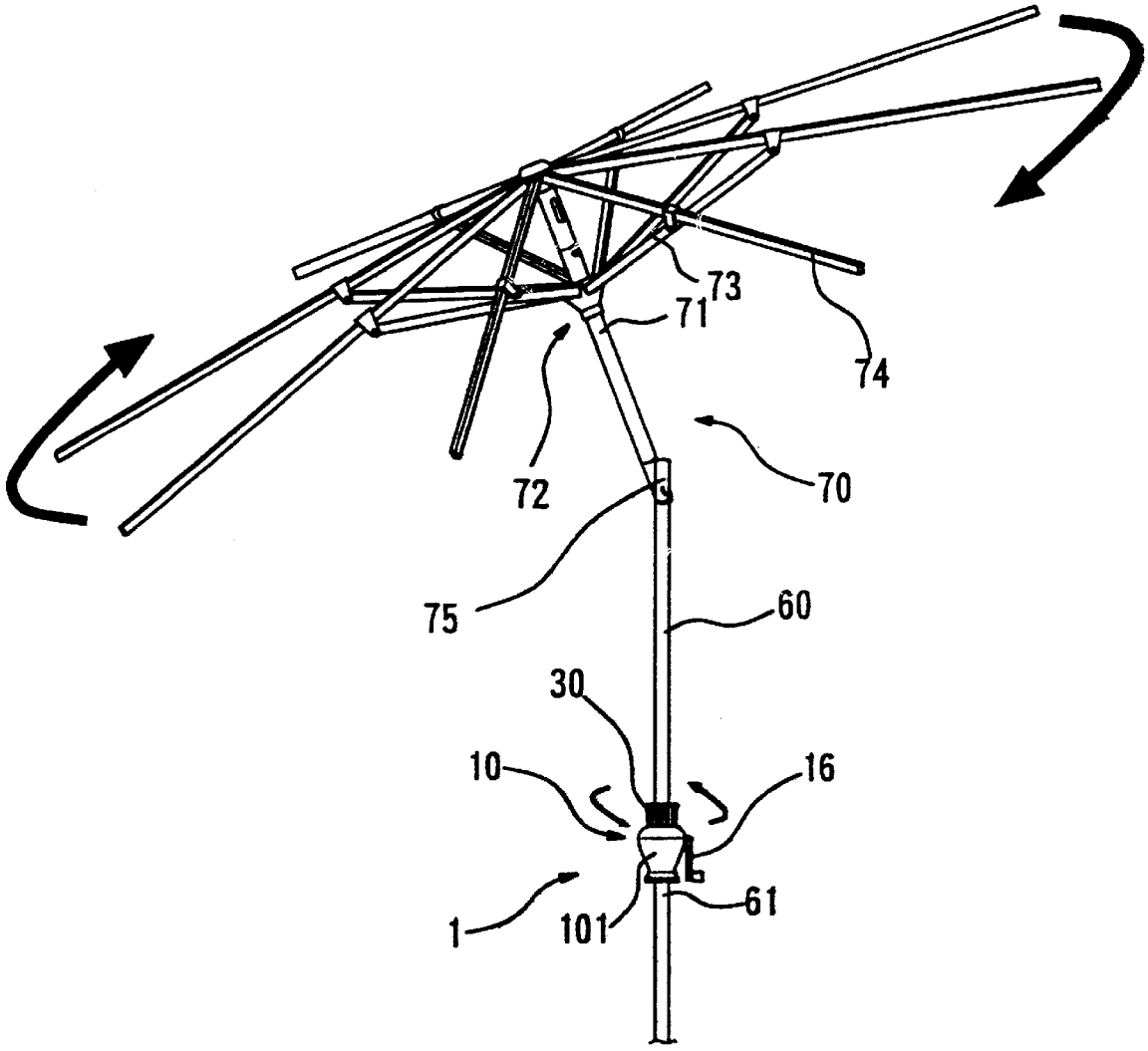
FIG. 6 is a schematic perspective view of the sunshade in accordance with the present invention.

Referring to FIG. 6, a sunshade in accordance with the present invention generally includes a main post consisting of an upper supporting tube 60 and a lower supporting tube 61. The sunshade further comprises a canopy frame 70 mounted to an upper end of the upper supporting tube 60. The canopy frame 70 comprises a rod 71 having a lower end pivotally mounted to a joint 75 mounted on the upper end of the upper supporting tube 60. The canopy frame 70 further comprises a runner 72 slidably mounted around the rod 71, plural ribs 74, and plural stretchers 73. Thus, the canopy frame 70 can be adjusted to a tilt position relative to the upper supporting tube 60, which is conventional and therefore not described in detail.

Figure 1:
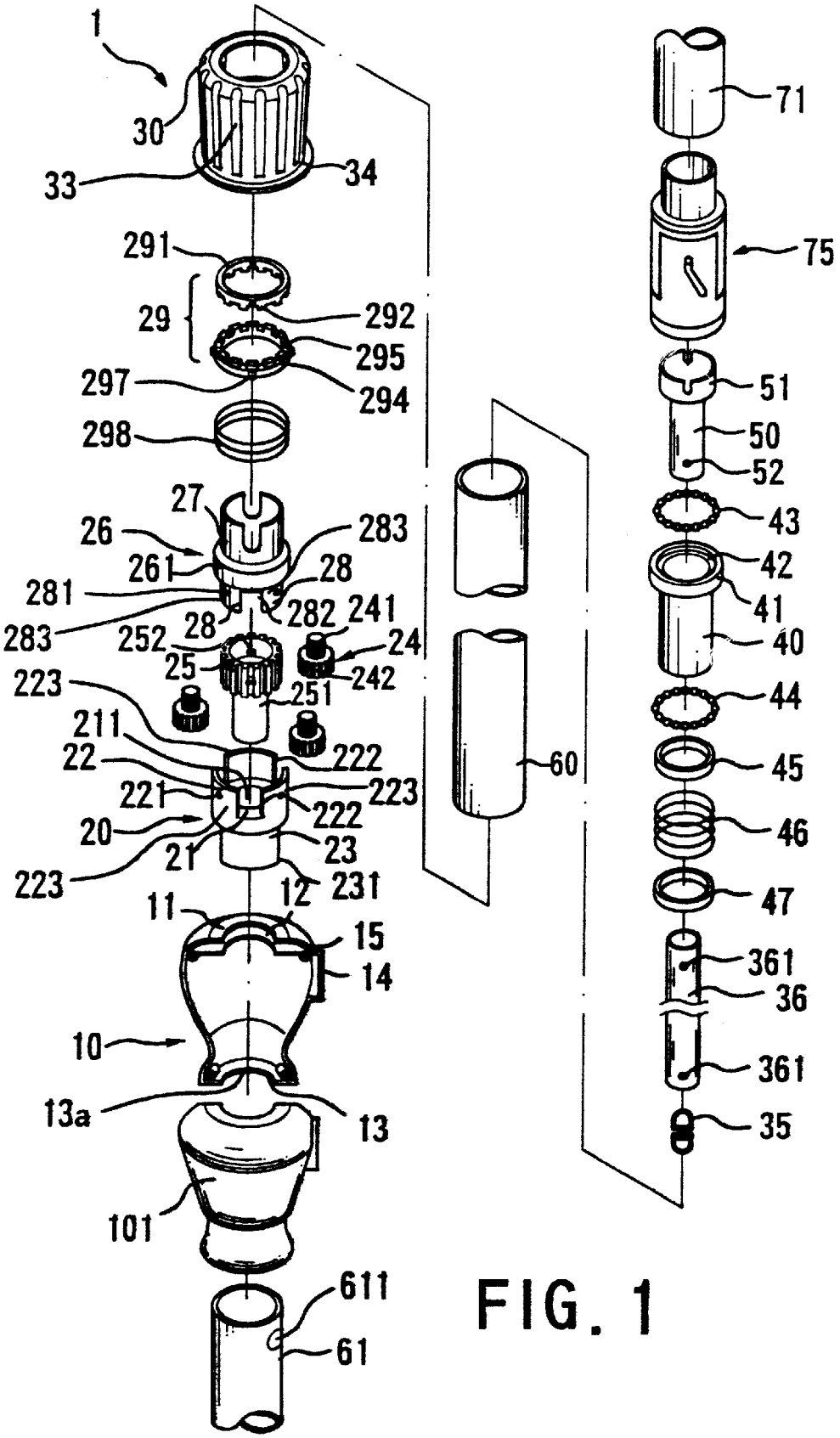
FIG. 1 is an exploded perspective view of a sunshade in accordance with the present invention.
Figure 2:
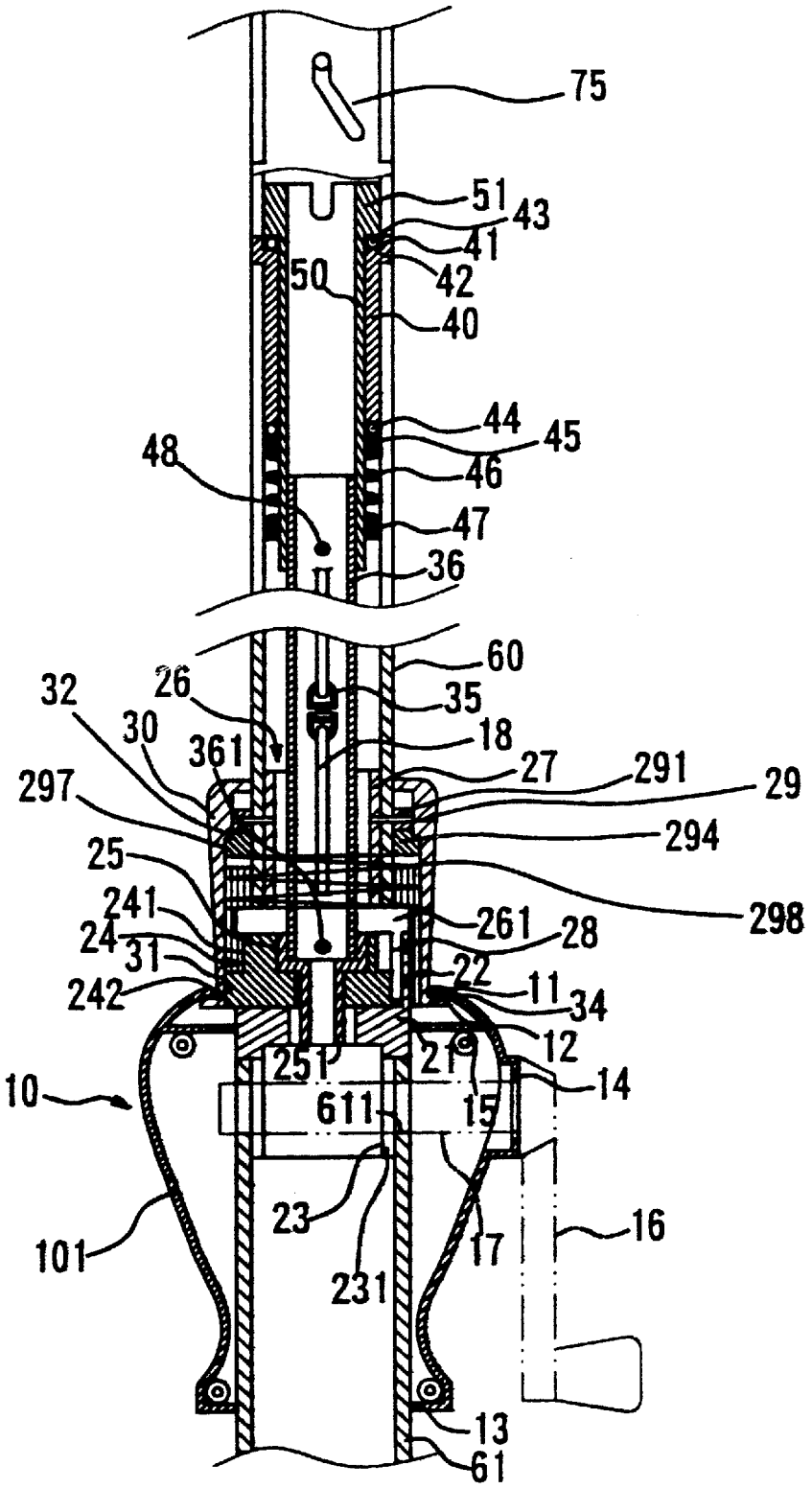
FIG. 2 is a sectional view of a lower portion of the sunshade in accordance with the present invention.

The sunshade further comprises a rotating device 1 for 360° rotational adjustment of the canopy frame 70 relative to the ground. Referring to FIGS. 1, 2, and 6, in an embodiment of the invention, the rotating device 1 comprises a casing 10, a lower coupler 20, an outer gear train 24, an inner gear 25, an upper coupler 26, a spring 298, a clutch 29, a first rotatable tube 36, a positioning tube 40, and a second rotatable tube 50. The casing 10 comprises two casing halves 101 each having an upper end 11 defining a recess 12 and a lower end 13 defining a recess 13*a*. A transverse semi-circular hole 14 is defined in a side of each casing half 101. When the casing halves 101 are assembled together, an upper hole consisting of recesses 12 is defined in the upper end of the casing 10, a lower hole consisting of recesses 13*a* is defined in the lower end of the casing 10, and a transverse hole consisting of semi-circular holes 14 is defined in a side of the casing 10. As illustrated in FIG. 2, the lower supporting tube 61 extends through the lower hole 13*a* of the casing 10 with an upper end of the former locating in an interior of the casing 10. Screws (not shown) are extended through positioning stubs 15 in each casing half 101 for securely engaging the casing halves 101 together.

The lower coupler 20 is a substantially tubular member 21 and comprises a lower end 23 having a transverse through-hole 231 (FIG. 2) and an upper end 22 having a plurality of angularly spaced notches 222, thereby defining a plurality of sections 223. Each solution 223 has a transverse hole 221, such as a through-hole or screw hole. The tubular member 21 extends through the upper hole 12 of the casing 10 with the lower end 23 of the tubular member 21 securely engaging with the upper end of the lower supporting tube 61, best shown in FIG. 2. The first coupler 20 further comprises a longitudinal hole 211.

A spool 17 extending laterally from an end of a handle 16 outside the casing 10 is extended through the transverse hole 14 of the casing 10, a transverse through-hole 611 in the upper end of the lower supporting tube 61, and the transverse through-hole 231 of the lower end 23 of the lower coupler 20.

The outer gear train 24 comprises plural dual gears rotatably mounted in the notches 222 of the lower coupler 22. Each dual gear comprises a first gear 241 and a second gear 242 that is integrally formed with the first gear 241 and coaxial with the first gear 241. In this embodiment, the first gear 241 is a relatively smaller upper gear while the second gear 242 is a relatively larger lower gear. The inner gear 25 is a hollow gear having a pair of diametrically disposed holes 252. The inner gear 25 further comprises a tubular member 251 extending from a bottom thereof into the longitudinal hole 211 of the lower coupler 20.

Figure 3:
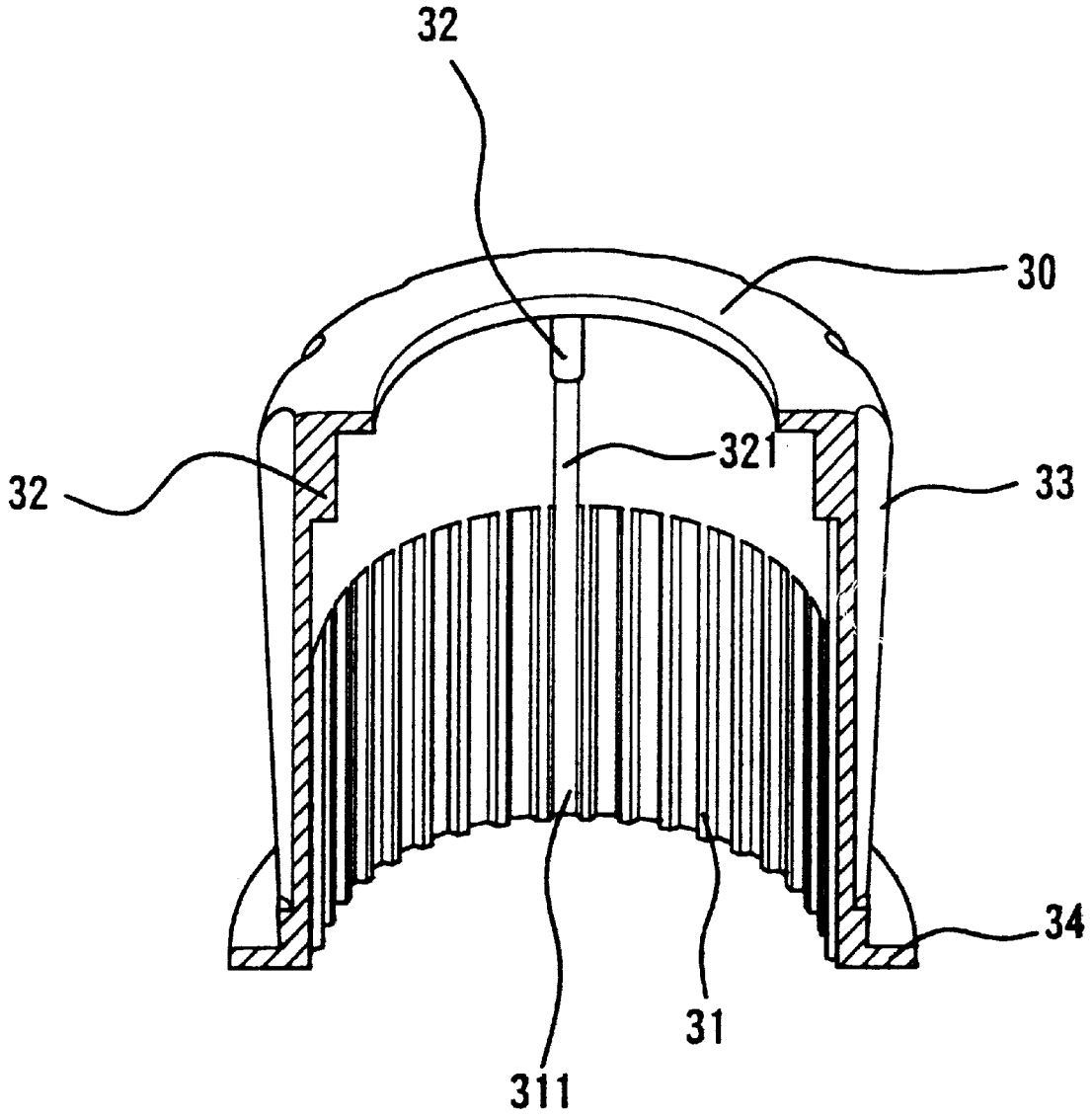
FIG. 3 is a perspective view, partly cutaway, of a sleeve of the sunshade in accordance with the present invention.

The upper coupler 26 is a substantially tubular member 261 having an upper end 27 and a lower end 28. The lower end 28 of the upper coupler 26 comprises a plurality of angularly spaced notches 282, thereby defining a plurality of sections 283. Each section 283 has a transverse hole 281, such as a through-hole or screw hole. The lower end 28 of the upper coupler 26 is mounted inside the upper end 22 of the lower coupler 20, wherein each section 283 of the former aligns with a respective section 223 of the latter, the transverse hole 281 of each section 283 of the former aligns with the transverse hole 221 of each section 223 of the latter, and each notch 282 of the former aligns with a respective notch 222 of the latter. A pin or screw is extended through the transverse hole 221 of each section 223 of the lower coupler 22 and the transverse hole 281 of each section 283 of the upper coupler 26 to thereby secure them together. The dual gears of the outer gear train 24 are respectively, rotatably mounted in the aligned notches 222 and 282 of the lower coupler 22 and upper couplers 26 and mesh with the inner gear 25 mounted in the lower end 28 of the upper coupler 26. Referring to FIGS. 1 through 3, the sleeve 30 comprises an inner periphery including plural annular teeth 31, a vertical groove 311 is defined between each two adjacent teeth 31. Several ribs 32 are formed on the inner periphery of the sleeve 30 and located above the teeth 31 and the grooves 311. As illustrated in FIG. 3, a vertical slide groove 321 extends from each rib 32 and communicates with an associated one of the vertical grooves 311. The sleeve 30 further comprises an anti-slip outer surface 33 and a flange 34 on a lower end thereof.

The clutch 29 comprises an upper ring 291 and a lower ring 294 that are mounted around the upper end 27 of the upper coupler 26. The upper ring 291 comprises plural teeth 292 on a bottom side thereof and the lower ring 294 comprises plural teeth 295 on an upper side thereof for releasably meshing with the teeth 292 of the upper ring 291. The spring 298 is mounted around the upper end 27 of the upper coupler 26 for biasing the lower ring 294 to engage with the upper ring 291. The lower ring 294 further comprises plural projections 297 on an outer periphery thereof.

Figure 4:
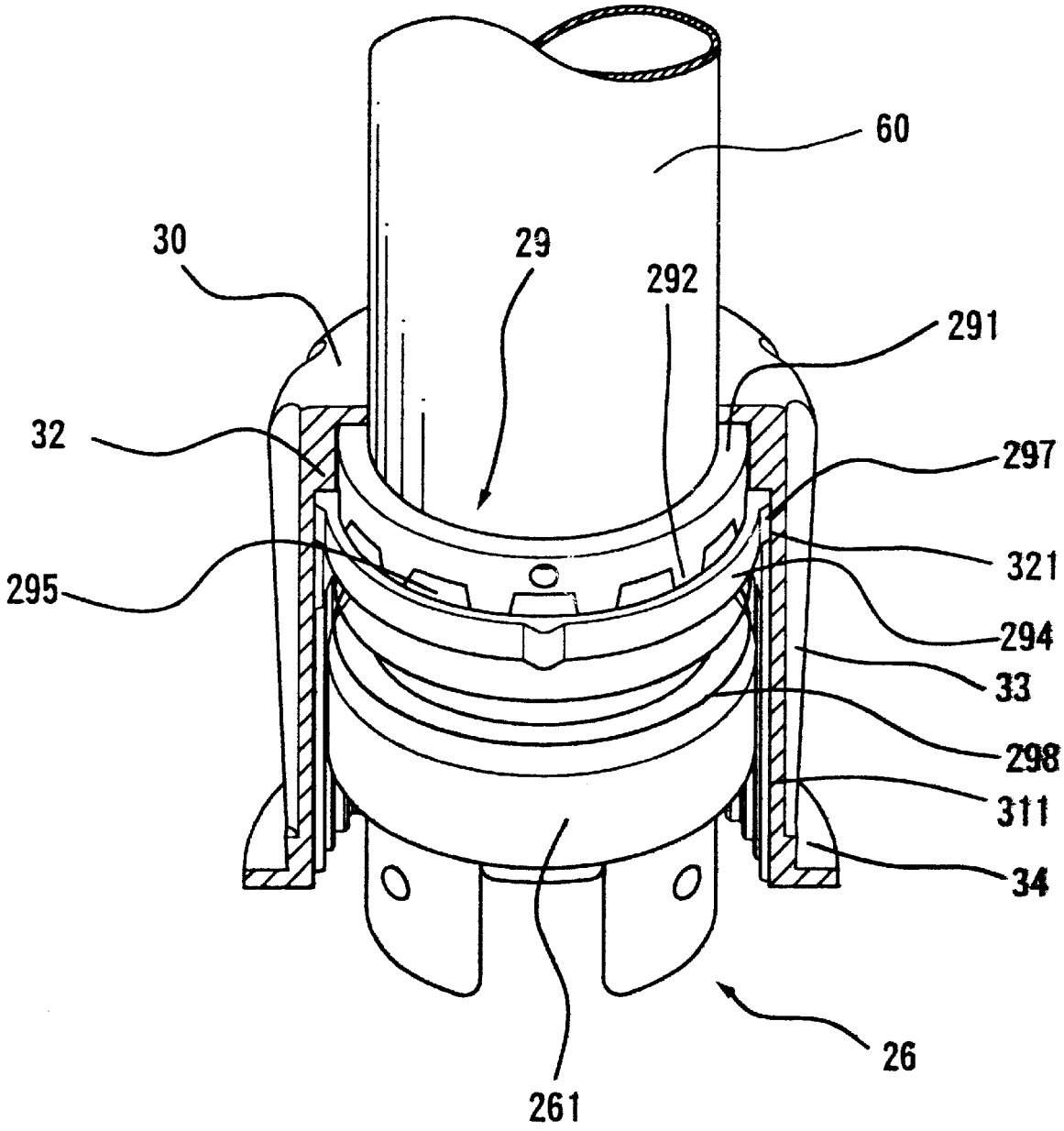
FIG. 4 is a perspective view, partly cutaway, of a portion of a rotating device in accordance with the present invention.

Referring to FIGS. 2 and 4, a lower end of the upper supporting tube 60 is mounted in the sleeve 30 and extends through the upper ring 291 and the lower ring 294 of the clutch 29. Screws (not shown) are extended through the upper ring 291, the lower end of the upper supporting tube 60, and the upper end 27 of the upper coupler 26 to secure them together. The projections 297 of the lower ring 294 are engaged in the vertical grooves 311, which, in turn, are communicated with associated slide grooves 321 of the sleeve 30. The lower ring 294 is biased by the spring 298 to urge the protrusions 297 of the lower ring 294 to slide along the slide grooves 321 of the sleeve 30 and to come in contact with the ribs 32.

The upper end 27 of the upper coupler 26 is securely mounted in the lower end of the upper supporting tube 60. The sleeve 30 is mounted around the upper coupler 26 and slidable along a vertical axis. In addition, the sleeve 30 is rotatable about the vertical axis. The teeth 31 of the sleeve 30 engage with the second gears 242 of the dual gears of the outer gear train 24. In addition, the flange 34 of the sleeve 30 is located in the casing 1 and has an outer diameter greater than the upper hole 12 of the casing 1 to thereby prevent disengagement of the sleeve 30 from the casing 10.

As illustrated in FIG. 2, the first rotatable tube 36 is mounted in the upper supporting tube 60 and has a lower end rotatably mounted in the upper coupler 26. The lower end of the first rotatable tube 36 is engaged in the hollow tubular inner gear 25 to rotate therewith. In this embodiment, a pin (not labeled) is extended through a hole 361 in the lower end of the first rotatable tube 36 and the diametrically disposed holes 252 of the hollow inner gear 25.

The positioning tube 40 comprises a flange 41 on an upper end thereof and is mounted in the upper end of the upper supporting tube 60. An upper end face of the flange 41 comprises an annular groove 42 for receiving a ball bearing 43. The second rotatable tube 50 comprises an upper end having a flange 51 mounted in the positioning tube 40 and a lower end beyond the lower end of the positioning tube 40. The second rotatable tube 50 is rotatably received in the positioning tube 40. In addition, for smooth rotation of the second rotatable tube 50, a ball bearing 44, an upper race 45, a spring 46, and a lower race 37 are mounted in sequence around the lower end of the second rotatable tube 50 beyond the lower end of the positioning tube 40. Further, the lower end of the second rotatable tube 50 is mounted around the upper end of the first rotatable tube 36. A pin 48 is extended through a hole 52 in the lower end of the second rotatable tube 50 and a hole 361 in the upper end of the first rotatable tube 36. Thus, the second rotatable tube 50 is turned when the first tube 36 is rotated. As illustrated in FIG. 2, the lower edge of the lower race 47 rests on the pin 48, and the spring 46 is pre-compressed to bias the ball bearing 44 to press against a lower edge of the positioning tube 40. The flange 51 on the upper end of the second rotatable tube 50 is securely mounted in the joint 75 to which the canopy frame 70 is pivotally connected.

A cable 18 has a section wound around the spool 17 is connected with another section of the cable 18 for folding/unfolding the canopy by a member 35 capable of preventing entangling of the cable 18. By means of operating the handle 16 to turn the spool 17, the cable 18 is retreated or released to move the runner 72, thereby folding or unfolding the canopy. When the canopy frame 70 is in its fully unfolded state, further rotation of the handle 16 in the releasing direction may pivot the canopy frame 70 to the desired tilt position, which is conventional and therefore not further described.

Figure 5:
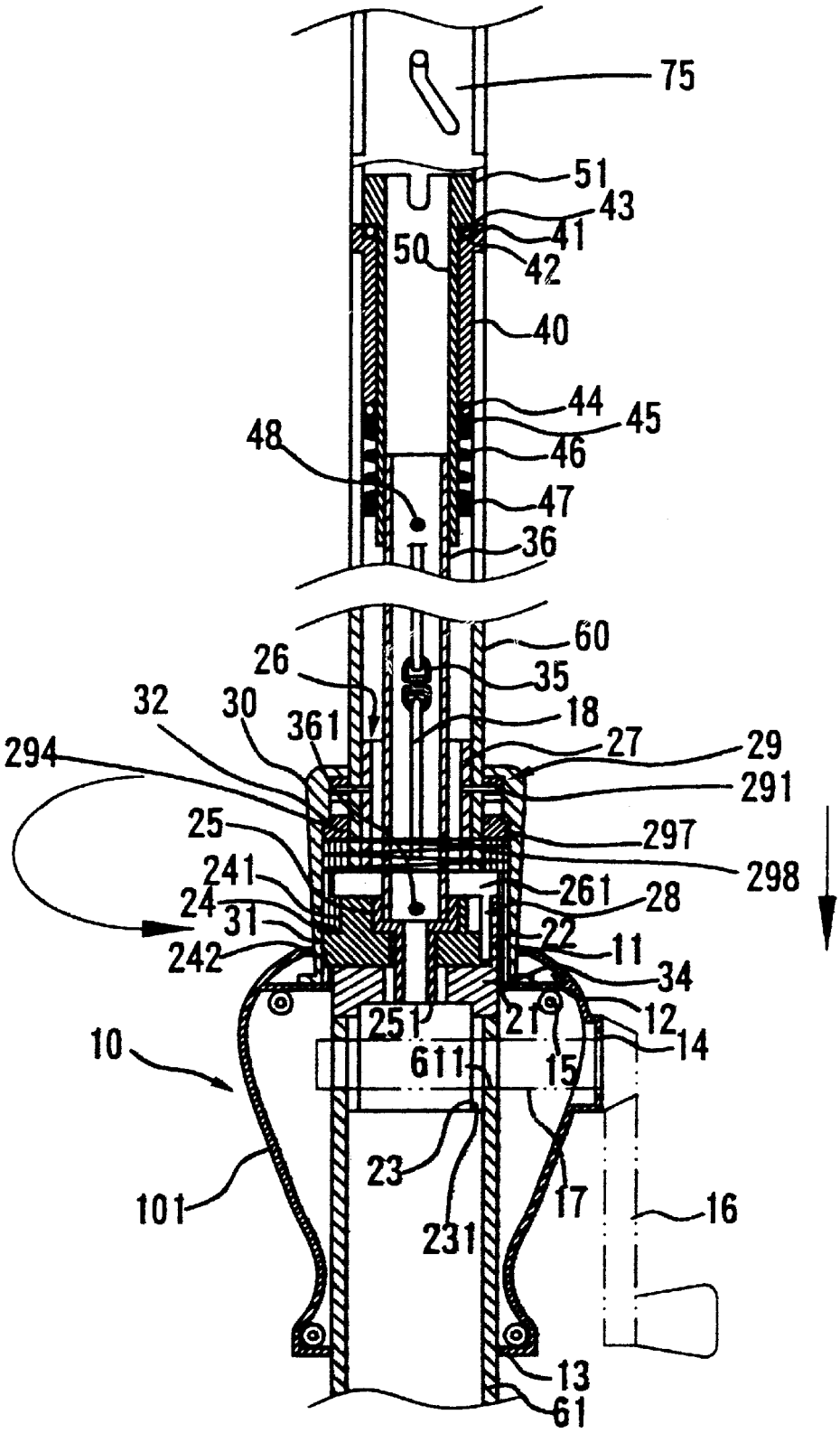
FIG. 5 is a sectional view similar to FIG. 2, illustrating rotational movement of the rotating device.

Referring to FIG. 6, the canopy frame 70 can be pivoted relative to the joint 75 to a desired tilt angle. In addition, 360°, rotational adjustment of the canopy frame 70 relative to the ground can be proceeded by means of using the rotating device 1 in accordance with the present invention. As illustrated in FIG. 5, the user may move the sleeve 30 downward, which moves the protrusions 297 of the lower ring 294 in the slide grooves 321 of the sleeve 30 downward to thereby disengage the lower ring 294 from the upper ring 291. Next, the sleeve 30 is rotated, which, in turn, causes rotation of the second gears 242 of the outer gear train 24, the first gears 241 of the outer gear train 24, the inner gear 25, and the first rotatable tube 36 that is secured to the inner gear 25. The second rotatable tube 50 is thus turned, which, in turn, causes rotation of the joint 75 and the canopy frame 70. Thus, the canopy frame 70 can be adjusted to the desired angular position relative to the ground for optimal shield. After adjustment, the user releases the sleeve 30, which is returned to its initial position for engaging the lower ring 294 with the upper ring 291 under the action of the spring 298. The sleeve 30 cannot be turned, as the clutch 29 is in a locked state, i.e., the lower ring 294 is engaged with the upper ring 291, which, in turn, is securely mounted to the fixed upper supporting tube 61.

According to the above description, it is appreciated that the canopy frame 70 can be pivoted relative to the joint 75 to a desired tilt angle. In addition, 360° rotational adjustment of the canopy frame 70 relative to the ground can be proceeded by means of using the rotating device 1 in accordance with the present invention, which can be easily achieved without difficulty.

Although the invention has been explained in relation to its preferred embodiment, it is to be understood that many other possible modifications and variations can be made without departing from the scope of the invention as hereinafter claimed.

What is claimed is:

1. A sunshade comprising:

a main post having an upper end;

a joint rotatably mounted to the upper end of the main post; and a canopy frame pivotally mounted to the joint;

the main post comprising an upper supporting tube having an upper end to which the joint is rotatably mounted and a lower end, the main post further comprising a lower supporting tube having an upper end, and a rotating device for rotating the joint and the canopy frame relative to the main post, wherein the rotating device comprises:

a rotating means mounted in the main post and securely connected to the joint to rotate therewith; and a sleeve rotatably mounted around the main post and operably connected to the rotating means, the rotating means and the joint being rotated when the sleeve is turned.

2. The sunshade as claimed in claim 1, wherein the sleeve is slidable along the main post between an operative position allowing rotational movement of the sleeve and a non-operative position in which rotational movement of the sleeve is prevented.

3. The sunshade as claimed in claim 1, wherein the rotating means comprises:

a first rotatable tube having a lower end and an upper end;

a second rotatable tube having a lower end and an upper end, the upper end of the second rotatable tube being securely mounted to the joint to rotate therewith, the lower end of the second rotatable tube is securely engaged with the upper end of the first rotatable tube to rotate therewith;

an inner gear securely mounted around the lower end of the first rotatable tube to rotate therewith; and an outer gear train mounted between the inner gear and the sleeve;

the sleeve comprising plural annular teeth on an inner periphery thereof for meshing with the outer gear train.

4. The sunshade as claimed in claim 3, further comprising a lower coupler securely mounted in the lower supporting tube and an upper coupler securely mounted in the upper supporting tube;

the lower coupler comprising a lower end and an upper end, the upper end of the lower coupler comprising plural notches;

the upper coupler comprising an upper end and a lower end securely mounted in the upper end of the lower coupler, the lower end of the upper coupler comprising plural notches aligned with the plural notches of the lower coupler, the upper end of the upper coupler being securely mounted in the lower end of the upper supporting tune;

the outer gear train comprising plural dual gears respectively, rotatably received in the notches of the lower coupler and the notches of the upper coupler, each of the dual gears comprising a first gear meshing with the inner gear and a second gear meshing with the plural annular teeth of the sleeve.

5. The sunshade as claimed in claim 4, wherein the plural notches of the upper coupler define plural sections, each of the sections having a hole the plural notches of the lower coupler defining plural sections aligned with the plural sections of the upper coupler each of the plural sections of the lower coupler including a hole aligning with an associated one of the holes of the upper coupler, further comprising a pin extending through each said hole of the lower coupler and each said hole of the upper coupler.

6. The sunshade as claimed in claim 4, further comprising a spool extending through the lower end of the lower coupler.

7. The sunshade as claimed in claim 4, further comprising an upper ring securely mounted around the lower end of the upper supporting tube and a lower ring slidably mounted around the lower end of the upper supporting tube, the upper ring and the lower ring being arranged to releasably engage with each other;

a spring for biasing the lower ring to engage with the upper ring;

the sleeve comprising at least one rib on the inner periphery thereof, the sleeve further including at least one vertical slide groove extending downward from said at least one rib, the lower ring comprising at least one protrusion slidably received in said at least one vertical slide groove and aligned with said at least one rib;

wherein when the sleeve is in the non-operative position, the lower ring is biased by the spring to engage with the upper ring to thereby prevent from rotational movement of the sleeve;

wherein when the sleeve is moved downward from the non-operative position to the operative position, said at least one protrusion of the lower ring is moved downward to disengage the lower ring from the upper ring, thereby allowing rotational movement of the sleeve.

8. The sunshade as claimed in claim 7, wherein the sleeve houses the outer gear train, the inner gear, the lower end of the upper supporting tube, the upper ring, and the lower ring.

9. The sunshade as claimed in claim 8, further comprising a casing mounted around the lower coupler.

10. The sunshade as claimed in claim 9, wherein the casing consists of two casing halves that together form a transverse hole, a lower hole through which the lower supporting tube extends, and an upper hole through which the lower coupler extends.

11. The sunshade as claimed in claim 9, further comprising a spool extending through the lower end of the lower coupler and the transverse hole of the casing halves, further comprising a handle extending from an end of the spool.

12. The sunshade as claimed in claim 10, wherein the sleeve comprises a flange received in the casing, the flange having an outer diameter greater than an inner diameter of the upper hole of the casing halves to thereby prevent disengagement of the sleeve from the casing.

13. The sunshade as claimed in claim 3, further comprising a positioning tube mounted in the upper supporting tube and having an upper end and a lower end, a flange being formed on the upper end of the positioning tube and including an upper end face, the upper end face of the flange including an annular groove for receiving a ball bearing, the upper end of the second rotatable tube comprising a flange rotatably supported by the ball bearing in the flange of the positioning tube.

14. The sunshade as claimed in claim 13, further comprising a ball bearing, an upper race, a spring, and a lower race mounted in sequence around the lower end of the second rotatable tube that extends beyond the lower end of the positioning tube.

15. The sunshade as claimed in claim 14, wherein the lower end of the second rotatable tube and the upper end of the first rotatable tube are secured together by a pin on which the lower race rests.

* * * * *